US010627199B1

(12) United States Patent
Denton et al.

(10) Patent No.: US 10,627,199 B1
(45) Date of Patent: Apr. 21, 2020

(54) ACTIVE COOLING SYSTEM FOR ELECTRONICS ON A MISSILE

(71) Applicant: MOOG Inc., East Aurora, NY (US)

(72) Inventors: Brandon Denton, Kenmore, NY (US); Christopher D. Strong, Glenwood, NY (US)

(73) Assignee: Moog Inc., East Aurora, NY (US)

( * ) Notice: Subject to any disclaimer, the term of this patent is extended or adjusted under 35 U.S.C. 154(b) by 191 days.

(21) Appl. No.: 14/926,396

(22) Filed: Oct. 29, 2015

Related U.S. Application Data

(60) Provisional application No. 62/072,020, filed on Oct. 29, 2014.

(51) Int. Cl.
*F42B 15/34* (2006.01)
*F25B 19/00* (2006.01)
*F25B 41/04* (2006.01)

(52) U.S. Cl.
CPC ..... *F42B 15/34* (2013.01); *F25B 19/005* (2013.01); *F25B 41/04* (2013.01)

(58) Field of Classification Search
CPC ..... H05K 7/20845; H05K 7/20854; H05K 7/20881; H05K 7/2039; H05K 7/20254; H05K 7/20263; H05K 7/20009; H05K 7/20436; H05K 7/20218; F42B 15/34; F25B 19/005; F25B 41/04; F25B 19/00; F25B 9/02; F25B 9/04; F28D 15/00; F28D 15/02; F17C 7/00; F17C 7/02; F17C 7/04; F17C 13/084; F17C 13/088; F17C 2221/013; F17C 2227/0369; F17C 2227/0376; F17C 2227/0381
USPC ..... 62/259.2; 165/104.21; 141/82
See application file for complete search history.

(56) References Cited

U.S. PATENT DOCUMENTS 5,184,470 A * 2/1993 Moser ..... H05K 7/20218 62/259.2
6,397,928 B1 6/2002 Sterner
6,578,491 B2 * 6/2003 Babin ..... F42B 15/34 361/700
6,581,412 B2 * 6/2003 Pant ..... F17C 9/02 62/50.2
6,603,662 B1 8/2003 Ganrot
(Continued)

FOREIGN PATENT DOCUMENTS

EP 2530284 B1 4/2015
FR 2883365 A1 * 9/2006 ..... F25B 9/02
WO 2013130557 A1 9/2013

OTHER PUBLICATIONS

Brown, Andy; Asetek's Vapochill CPI Cooling System—A Darth Vader Suit for an Overclocked PC; http:/techreport.com/review/4878/asetek-vapochill-cpi-cooling-system; Mar. 17, 2014.

*Primary Examiner* — Jianying C Atkisson
*Assistant Examiner* — Tavia Sullens
(74) *Attorney, Agent, or Firm* — Harter Secret & Emery LLP

(57) ABSTRACT

A vessel (10) containing a fluid (liquid and/or gas) at pressure higher than atmospheric pressure which when evacuated from the vessel (10) lowers the temperature of the vessel and thereby creates a self-generated cold sink capable of absorbing thermal energy to maintain electronics and other temperature sensitive missile components within their operational temperature limits.

17 Claims, 3 Drawing Sheets

(56) References Cited

U.S. PATENT DOCUMENTS

| | | | | |
|---|---|---|---|---|
| 7,081,802 | B2 * | 7/2006 | Bonaquist | F25B 19/005 336/55 |
| 7,233,493 | B2 | 6/2007 | Wang et al. | |
| 8,077,464 | B2 | 12/2011 | Brok et al. | |
| 8,279,601 | B2 | 10/2012 | Lima et al. | |
| 2006/0249279 | A1 | 11/2006 | Chordia et al. | |
| 2010/0024445 | A1 | 2/2010 | Cichanowicz | |
| 2010/0090688 | A1 | 4/2010 | Mednikov | |
| 2010/0134997 | A1 | 6/2010 | Heim | |
| 2011/0058637 | A1 | 3/2011 | Campbell et al. | |
| 2011/0239683 | A1 | 10/2011 | Czamara et al. | |
| 2013/0291553 | A1 | 11/2013 | Leland et al. | |

* cited by examiner

ACTIVE COOLING SYSTEM FOR ELECTRONICS ON A MISSILE

CROSS-REFERENCE TO RELATED APPLICATION

The present application claims priority benefit of U.S. Provisional Patent Application No. 62/072,020 entitled "Active Cooling System for Electronics on a Missile" filed on Oct. 29, 2014, which is incorporated herein by reference.

TECHNICAL FIELD

The present invention relates generally to the field of cooling for electronics, and more particularly to a system and a method for cooling electronics on an aerial vehicle or missile.

BACKGROUND ART

Typically electronic components are designed to work at relatively low temperatures, thus the heat that they generate must be efficiently removed. Traditionally, removal of heat was achieved through the use of a fan, or equivalent device for passing cool air over the components. In some applications fan cooling may not be sufficient or may otherwise be undesirable. Computer manufacturers have used additional heat removal devices such as heat pipes, fins, pin fins, etc. to aid in the removal of heat. In addition, prior devices/methods have attempted to store the heat using thermal capacitance either as a phase change or mass increase. Prior devices/methods require the phase change to occur at temperatures between the initial temperature and the maximum operational temperature of the electronics thereby limiting the thermal margin, scalability and operational time of these systems.

BRIEF SUMMARY OF THE INVENTION

With parenthetical reference to the corresponding parts, portions or surfaces of the disclosed embodiment, merely for the purposes of illustration and not by way of limitation, the present invention provides an active cooling system for electronics on a missile. The system may comprise a vessel (10) containing a fluid (liquid and/or gas) at a pressure above atmospheric pressure which when evacuated from the vessel (10) lowers its temperature and creates a self-generated cold sink capable of absorbing thermal energy to maintain electronics and other temperature sensitive missile components within their operational temperature limits.

The rate of cooling provided by the vessel (10) is controlled by a solenoid valve (13) which is capable of starting and stopping the flow of fluid from the vessel (10).

The components requiring cooling are connected to the vessel (10) via a thermally conductive member (25).

Accordingly, an object of the present invention is to provide a single use, lightweight system that removes heat from electronics or other temperature sensitive components.

Another object is to generate a cold thermal sink below the environmental temperature, thereby potentially cooling the electronics to a temperature colder than the environmental temperature allowing for the system to increase thermal margin, scalability and operational time.

DESCRIPTION OF THE PREFERRED EMBODIMENTS

Figure 1:
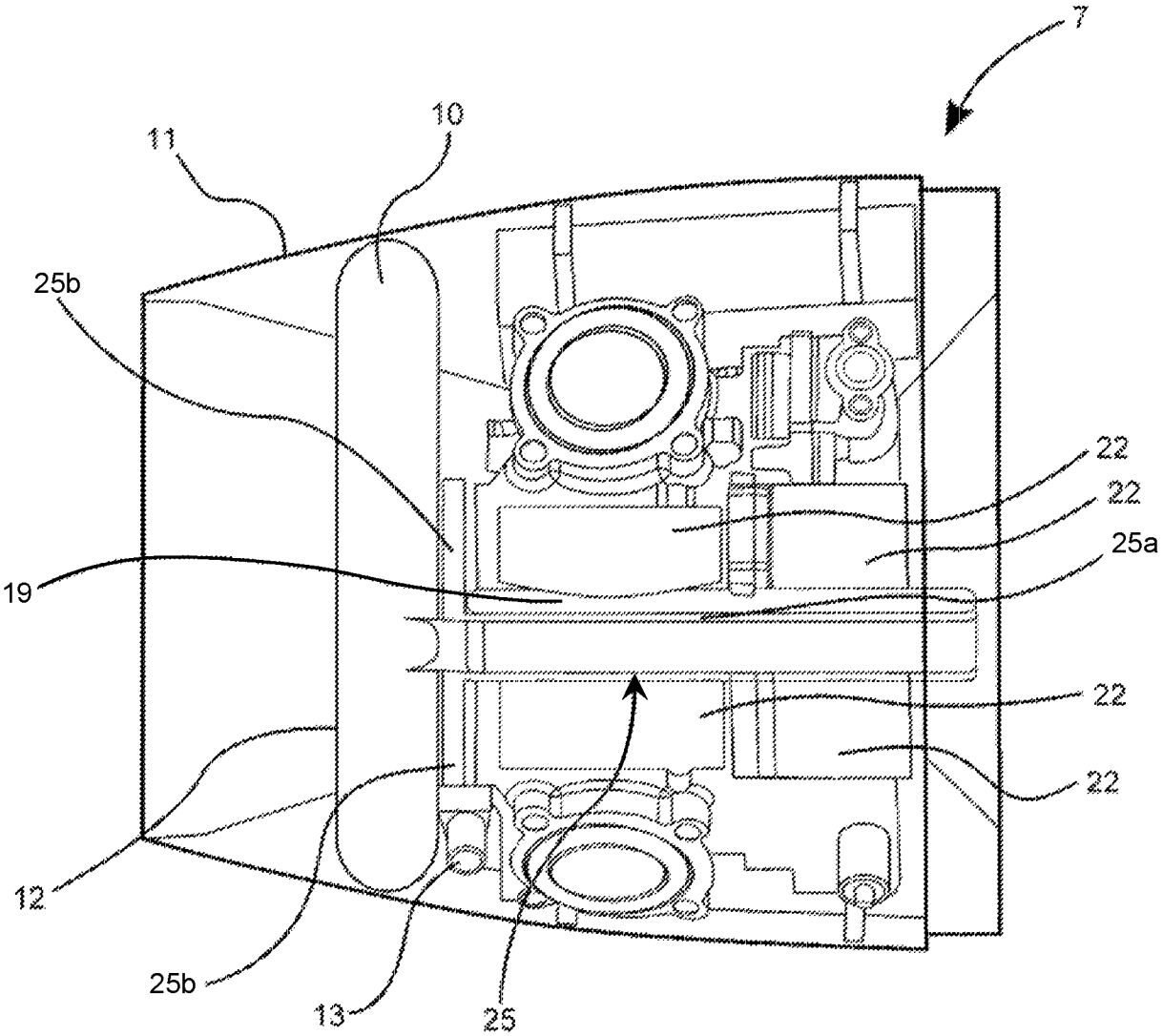
FIG. 1 is a perspective view of one embodiment of the active cooling system system.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 2:
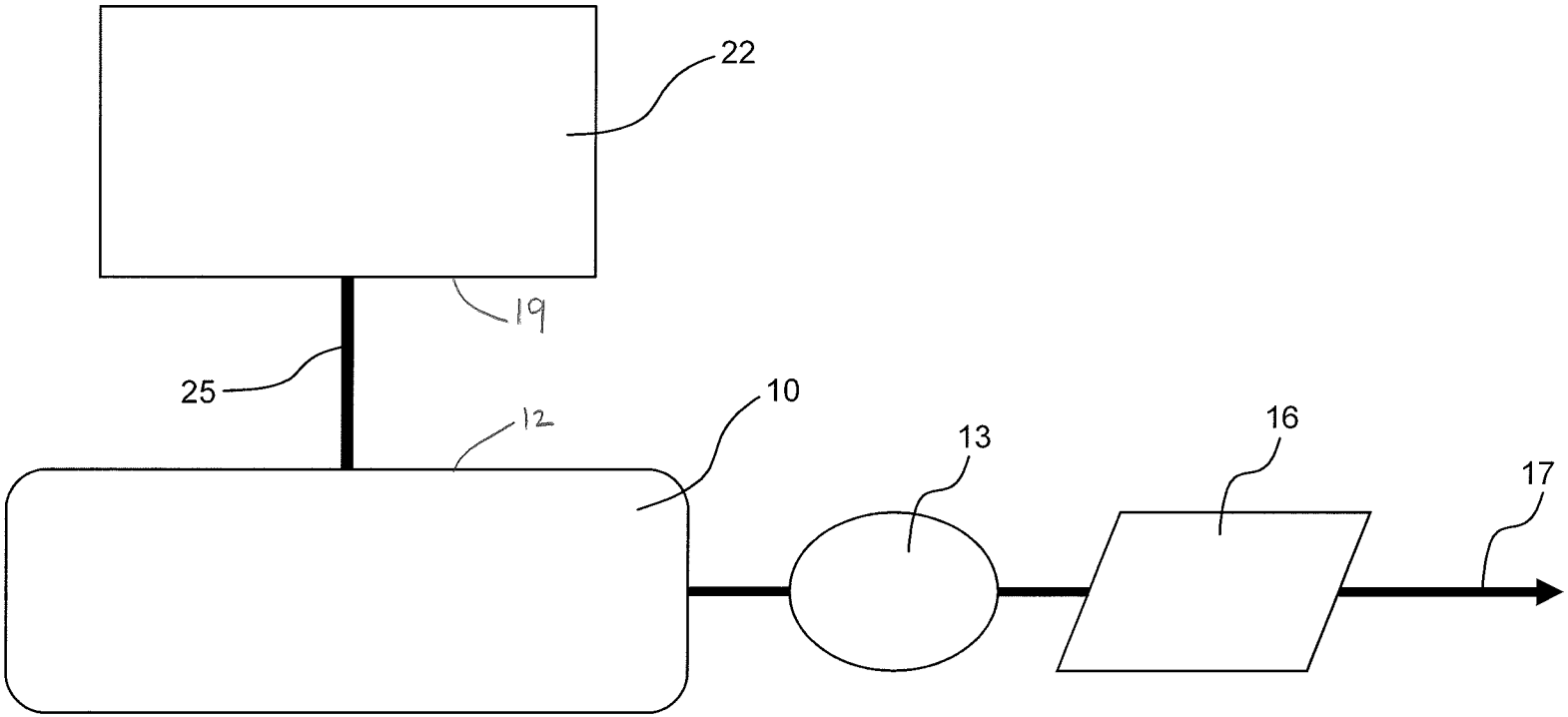
FIG. 2 is a schematic diagram of the active cooling system of FIG. 1.

Referring now to the drawings, and more particularly to FIGS. 1 and 2 thereof, this invention provides a system 7 for removing heat from an electronic circuit. The system 7 includes a vessel 10 for storing a pressurized gas such as carbon dioxide. As shown in FIG. 1, the vessel 10 may be provided inside the body 11 of a missile, aerial vehicle or the like. The system may also be used as a single use, low weight system in other applications for removing heat from electronic circuits. The vessel 10 may be constructed of a lightweight, high strength material suitable for storing gases under pressure. The vessel 10 is provided with an outlet valve 13 that may be solenoid actuated. The solenoid actuated valve 13 is capable of starting and stopping the flow of fluid from the vessel 10. The valve 13 may be disposed in fluid communication with a Venturi section 16 (FIG. 2) to provide for reducing the pressure and increasing the velocity of the gas flowing into the surrounding environment in the direction of arrow 17.

When gas is constantly expelled from the vessel 10, it lowers the temperature of the of the vessel 10 to provide a heat sink due to the thermodynamic expansion of the gas in the vessel 10. The outer surface 12 of the vessel 10 is connected to a thermally conductive surface 19 on the electronic circuit 22 by a thermally conductive member 25. The thermally conductive member 25 is constructed of a material having a very high rate of thermal conductivity such that heat generated by the electronic circuit 22 is conveyed to the outer surface 12 of the vessel 10, via a heat conductive surface **25*b* of the thermally conductive member 25, which acts as a heat sink to remove heat from the electronic circuit 22. As shown in FIG. 2, in an embodiment, the heat conductive surface 25*b* is positioned at an angle with respect to the longitudinal axis of the body 25*a* of the thermally conductive member 25. In an embodiment, the thermally conductive member 25** is a heat pipe.

Figure 3:
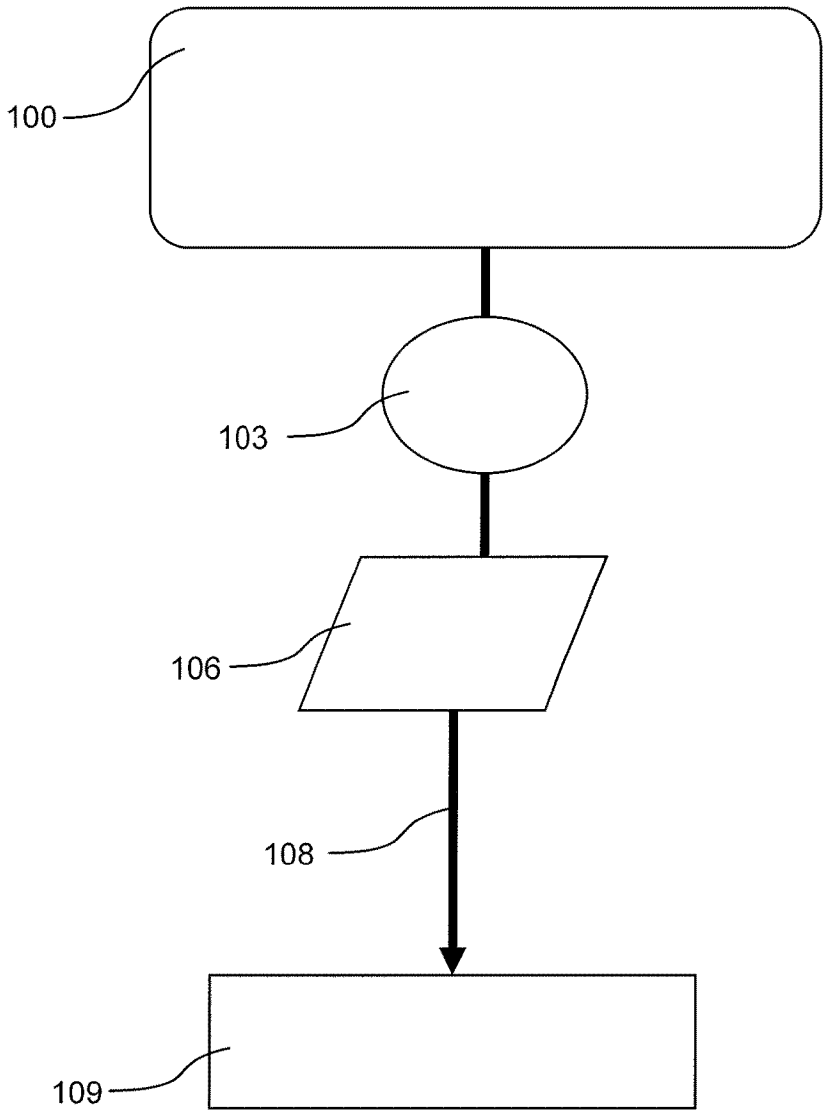
FIG. 3 is a schematic diagram of an alternate embodiment of the system.

Turning to FIG. 3, in an alternate embodiment vessel 100 contains a pressurized gas such as carbon dioxide. The outlet of the vessel 100 includes a solenoid actuated valve 103 which controls the starting and stopping of flow of gas exiting the vessel 100. The pressurized gas passes through a Venturi section 106 which decreases the pressure and increases the velocity of the gas flowing from the vessel 100. The pressurized gas released form the vessel 100 may be blown in the direction of arrow 108 directly onto high power dissipative components on the electronic circuit 109 or the cold gas exiting the vessel 100 may pass through a heat exchanger thereby cooling the electronics. The heat exchanger may be integrated into the electronic circuit board.

The present invention contemplates that many changes and modifications may be made. Therefore, while the presently-preferred form of the active cooling system has been shown and described, and several modifications and alternatives discussed, persons skilled in this art will readily appreciate that various additional changes and modifications may be made without departing from the spirit of the invention, as defined and differentiated by the following claims.

The invention claimed is:

1. A method of cooling an electronic circuit inside a vehicle body, the method comprising:

providing a vessel containing a pressurized fluid having a pressure above atmospheric pressure, the vessel having an outlet;

providing a valve at the outlet of the vessel, wherein the valve is operable to selectively control a flow of the pressurized fluid from the vessel;

providing a thermally conductive member disposed between a surface of the electronic circuit and an outer surface of the vessel, the thermally conductive member contained inside the vehicle body;

wherein the thermally conductive member extends between and is physically connected with the outer surface of the vessel and the heat conductive surface of the electronic circuit;

wherein the thermally conductive member further includes a heat conductive surface extending outward therefrom and connected with the vessel at an angle to a longitudinal axis of the thermally conductive member;

opening the valve to provide a flow of the pressurized fluid from inside the vessel, wherein the flow of the pressurized fluid causes the temperature of the vessel to decrease such that heat flows from the electronic circuit to the surface of the vessel via the thermally conductive member, wherein a rate of cooling the electronic circuit is controlled by the valve.

2. The method of claim 1, wherein the thermally conductive member comprises a heat pipe.

3. The method of claim 1, wherein the vehicle is an aerial vehicle.

4. The method of claim 1, wherein the vehicle is a missile.

5. The method of claim 1, further comprising providing a venturi section disposed in fluid communication with the outlet of the vessel.

6. The method of claim 1, further comprising providing a solenoid for controlling the valve.

7. The method of claim 1, wherein the pressurized fluid is a gas.

8. The method of claim 7, wherein the gas is carbon dioxide.

9. An active cooling system, comprising:

a missile body;

a vessel containing a pressurized fluid having a pressure above atmospheric pressure disposed inside the missile body, the vessel having an outlet with a valve operable to selectively control a flow of the fluid from the vessel through the outlet, the vessel having an outer surface;

a venturi section connected with the outlet of the vessel such that the pressurized fluid selectively flows through the vessel outlet and the venturi section, wherein all flow through the vessel outlet flows through the venturi section;

a temperature sensitive component disposed inside the missile body; and a thermally conductive member disposed between and is physically connected with the outer surface of the vessel and a heat conductive surface of the temperature sensitive component;

wherein expulsion of the pressurized fluid from the vessel causes the temperature of the vessel to decrease causing the flow of heat from the temperature sensitive component to the vessel via the thermally conductive member.

10. The active cooling system of claim 9, wherein the thermally conductive member comprises a heat pipe.

11. An active cooling system, comprising:

a vehicle body;

a vessel containing a pressurized fluid having a pressure above atmospheric pressure disposed inside the vehicle body, the vessel having an outlet comprising a valve operable to selectively control a flow of the pressurized fluid from the vessel through the outlet, the vessel having an outer surface;

an electronic circuit disposed inside the vehicle body, the electronic circuit generating heat during operation;

a thermally conductive member disposed between the outer surface of the vessel and a heat conductive surface of the electronic circuit, the thermally conductive member being a heat pipe contained inside the vehicle body;

wherein the thermally conductive member extends between and is physically connected with the outer surface of the vessel and the heat conductive surface of the electronic circuit;

wherein the thermally conductive member further includes a heat conductive surface extending outward therefrom and connected with the vessel at an angle to a longitudinal axis of the thermally conductive member; and wherein expulsion of the pressurized fluid from the vessel causes the temperature of the vessel to decrease causing flow of heat from the electronic circuit to the vessel via the thermally conductive member.

12. The system of claim 11, wherein the vehicle is an aerial vehicle.

13. The system of claim 11, wherein the vehicle is a missile.

14. The system of claim 11, further comprising:

a venturi section connected with the outlet of the vessel;

wherein the pressurized fluid flows through the vessel outlet, through the venturi section into the inside of the vehicle body; and wherein the venturi section is operable to create a choked flow of the pressurized fluid flowing into the inside of the vehicle body.

15. The system of claim 11, wherein the valve is actuated by a solenoid.

16. The system of claim 11, wherein the pressurized fluid is a gas.

17. The system of claim 16, wherein the gas is carbon dioxide.

* * * * *